US008246323B2

(12) United States Patent
Bellis, Sr.

(10) Patent No.: US 8,246,323 B2
(45) Date of Patent: Aug. 21, 2012

(54) PROGRAMMABLE LOGIC CONTROLLED LIQUID PRESSURIZATION DEVICE INCORPORATING LOW ENERGY CONSUMPTION MECHANISMS FOR THE UTILIZATION OF SOLAR ENERGY

(76) Inventor: George Patterson Bellis, Sr., Erath, LA (US)

( * ) Notice: Subject to any disclaimer, the term of this patent is extended or adjusted under 35 U.S.C. 154(b) by 848 days.

(21) Appl. No.: 12/346,594

(22) Filed: Dec. 30, 2008

(65) Prior Publication Data

US 2010/0163124 A1 Jul. 1, 2010

(51) Int. Cl.
*G05D 16/20* (2006.01)

(52) U.S. Cl. ..... 417/410.1; 417/269; 417/270; 137/565.16

(58) Field of Classification Search ..... 417/410.1, 417/269, 270; 137/565.5
See application file for complete search history.

(56) References Cited

U.S. PATENT DOCUMENTS 5,752,811 A * 5/1998 Petro ..... 417/416
2006/0008361 A1 * 1/2006 Sanderson et al. ..... 417/269
* cited by examiner

*Primary Examiner* — Tracie Y Green

(57) ABSTRACT

A liquid pressurization device which is housed within a single rectangular housing that utilizes a solar panel as the front cover and the only source of energy. An interchangeable pulley mounted on a motion controlled technology motor allows for a wide range of pressure and volume scenarios common to liquid pressurization applications, and in combination with a motor controller and driver board, and programmable logic control board, these pressure and volume scenarios are further optimized for the utilization of solar energy as the sole energy source. Said programmable logic board further provides ports for firmware updates, monitoring devices, and diagnostic devices. A lever is reciprocated by an energy transfer pulley that transfers drive force to the liquid end of the apparatus, providing a low friction multiplication of available power. The liquid end of the apparatus is further designed for ease of maintenance to replaceable components with limited life spans.

6 Claims, 7 Drawing Sheets

MOTOR CONTROLLER AND DRIVER BOARD
PROGRAMMABLE LOGIC CONTROL BOARD

STEPPER MOTOR
BATTERY
BATTERY
BATTERY
14
44
40
42
38
54
52
31
41
43
30
10
46
28
22
26
24
48
50
12
18
20
34
36
56
58
62
64
66
66
68
16
74
14
32
30
22
70
26
12
56
58
60
50
80
78
76
68

PROGRAMMABLE LOGIC CONTROLLED LIQUID PRESSURIZATION DEVICE INCORPORATING LOW ENERGY CONSUMPTION MECHANISMS FOR THE UTILIZATION OF SOLAR ENERGY

BACKGROUND OF THE INVENTION

1. Field of the Invention

The apparatus of the present invention relates to devices for transferring liquids from a atmospheric pressure container into a higher pressure vessel or flow line to create a dilution of said liquid into the fluids flowing through said higher pressure vessel or flow line. More particularly, the present invention relates to the conservation of power required to utilize solar energy to pressurize said atmospheric pressure liquid sufficiently for introduction into said higher pressure vessel or flow line, at locations where other sources of energy are unavailable.

2. General Background of the Invention

In the technology of pressurizing an atmospheric liquid for introduction into a higher pressure vessel or flow line, there has developed a technique whereby devices of various design utilize a variety of different power sources to achieve a metered amount of an atmospheric liquid to create a preferred dilution of said atmospheric liquid into the higher pressure fluids flowing through a higher pressure vessel or flow line. Many locations where this technique is practiced have little or no energy source available to power these devices, which has turned the industry to solar power for this purpose at these types of locations. In the current state of the art, many devices that were previously designed to utilize alternating current and other more powerful energy sources have been retrofitted to utilize solar energy. These retrofitted devices consume an excess of power due to their initial design parameters, and require large battery packs and solar panels to store and replenish power.

BRIEF SUMMARY OF THE INVENTION

The apparatus and method of the present invention solves this problem in a simple and straight forward manner. What is provided is a Programmable Logic Controlled apparatus utilizing very low friction mechanical components to optimize the usage of the flow of power currently available using solar panels, in the current state of the art. Utilization of said low friction mechanical components further provides a compact unitized design that is comparatively light weight, and can be installed in a fraction of the time required by current devices, in the current state of the art. The apparatus includes a rectangular housing with a hinge fixture along the front of the top wall for attachment of a solar panel element that also acts as the cover for the electronic and drive portion of the apparatus. In the upper portion of the rectangular housing, a motion controlled technology motor is attached to the back wall of the rectangular housing. Above said motion controlled technology motor and also attached to the back of the rectangular housing is a mounting fixture with a transfer pulley threadably attached with an intervening bearing, wherein said mounting fixture provides an equal distance from said back wall as is provided by said motion controlled technology motor. Near the outer most point of the diameter of the transfer pulley, and on the front surface of said transfer pulley, another bearing assembly is threadably attached to said transfer pulley, which will be discussed further. There is also provided a motor controller and driver board attached to the top left front corner of the back wall of the rectangular housing that interprets instructions from a programmable logic control board attached to the top right front corner of the back wall of the rectangular housing, which transmits these instructions to said motion controlled technology motor. Power for said motor controller and driver board, programmable logic control board and motion controlled technology motor is provided by two banks of six rechargeable and replaceable batteries located mid way between the upper wall and lower wall of the rectangular housing and attached to the front of the back wall of said rectangular housing in a manner wherein they can be replaced. There is further provided a generally elongated rectangular bar having a slot bored completely through the top portion of said generally elongated rectangular bar from front to back, for connecting to the aforementioned bearing assembly threadably attached near the outer most point of the diameter of the transfer pulley. Said generally elongated rectangular bar has one additional hole, bored front to back, located four fifths of the total length of the generally elongated rectangular bar, which will be discussed further. Three fourths of the distance from top wall to bottom wall of the rectangular housing, and centered between the left wall and right wall of the rectangular housing, a mounting block is permanently attached to the front of the back wall of the rectangular housing, providing an equal distance from the back wall of the rectangular housing, in relation to the front surface of the aforementioned transfer pulley. Said mounting block further provides a connection point on its front surface for threadable attachment of the aforementioned hole located four fifth's of the total length from the top of the generally elongated rectangular bar, with an intervening bearing to provide free movement. The permanent attachment of said mounting block to the front of the back wall of the rectangular housing provides a monument for the placement and alignment of all other components of the apparatus of the current invention. Said connection point creates a pivot point for the generally elongated rectangular bar, providing a lever action for power conservation at the pump assembly located below said pivot point, which will be discussed further. There is further provided a liquid pressurization assembly located in the lower portion of the rectangular housing, that is specifically designed to utilize the curved path of force provided by the generally elongated rectangular bar pivoting at said mounting block. The bottom of the generally elongated rectangular bar is shaped with a triangular point facing to the left and an additional triangular point facing to the right, that provides a single point of contact in both directions for the distribution of force provided by the generally elongated rectangular bar. The curved path of the bottom end of the generally elongated rectangular bar requires intervention of a roller assembly in both directions to provide a true perpendicular motion to the plunger retainer assembly of the liquid pressurization assembly, which will be discussed further. Said liquid pressurization assembly in the lower portion of the rectangular housing comprises one pressure chamber located to the left of the generally elongated rectangular bar, and one pressure chamber located to the right of the generally elongated rectangular bar. Said pressure chambers are positioned exactly perpendicular to the triangular contact points at the lower end of the generally elongated rectangular bar, and fitted with seals within threadably attached retainers. A plunger retainer assembly with plungers attached facing left and right is reciprocated by the contact tips at the lower end of the generally elongated rectangular bar in contact with roller assemblies within said plunger retainer assembly, causing said plungers to travel sealably in and out of both pressure chambers in sequence, providing a constant influx of atmospheric pressure liquids and a constant output of pressurized liquids. Suction check valves, and discharge check valves mounted on both of the pressure chambers allow for the constant flow of pressurized liquids to the discharge line and introduction into a higher pressure vessel or flow line. Bleed valves are also provided in relation to the suction and discharge check valves for purging air from said pressure chambers when liquid has been evacuated for maintenance, or at initial start-up. There is further provided a support fixture, threadably attached to the left and right side walls of the rectangular housing that is extended to the rear when the liquid pressurization device is set up, to allow positioning of the solar panel front cover of the liquid pressurization device, to achieve maximum exposure to sunlight.

Therefore it is the principle object of the present invention to provide an improved single apparatus for pressurizing atmospheric liquids into a higher pressure vessel or flow line to create a preferred dilution of said atmospheric liquids in fluids flowing through said higher pressure vessel or flow line.

It is a further object of the present invention to provide an improved single apparatus that is specifically designed for energy conservation and utilization of solar energy.

It is a further object of the present invention to provide an apparatus that utilizes a motion controlled technology motor and programmable logic control technology to introduce exact amounts of a pressurized liquid into a higher pressure vessel or flow line, creating accurate dilutions in fluids traveling through said higher pressure vessels or flow lines.

It is further object of the present invention to provide an apparatus that is unitized and utilizes space already required by a solar panel to house a lever device provided by the generally elongated rectangular bar, threadably attached to a mounting block with an intervening bearing assembly.

It is a further object of the present invention to provide a solution to the curved path of triangular points at the lower end of the generally elongated rectangular bar, with roller assemblies to maintain a straight path in and out of the pressure chambers.

It is a further object of the present invention to provide a constant flow of higher pressure liquid from the discharge line of the liquid pressurization assembly which can be critical in maintaining exact dilutions of the atmospheric pressure liquid in the higher pressure fluids traveling through higher pressure vessels or flow lines.

BRIEF DESCRIPTION OF THE DRAWINGS

For a further understanding of the nature, objects, and advantages of the present invention, references should be had to the following detailed description, read in conjunction with the following drawings, wherein like reference numerals denote like elements and wherein.

DETAILED DESCRIPTION OF THE INVENTION

Figures 1A, 1B:
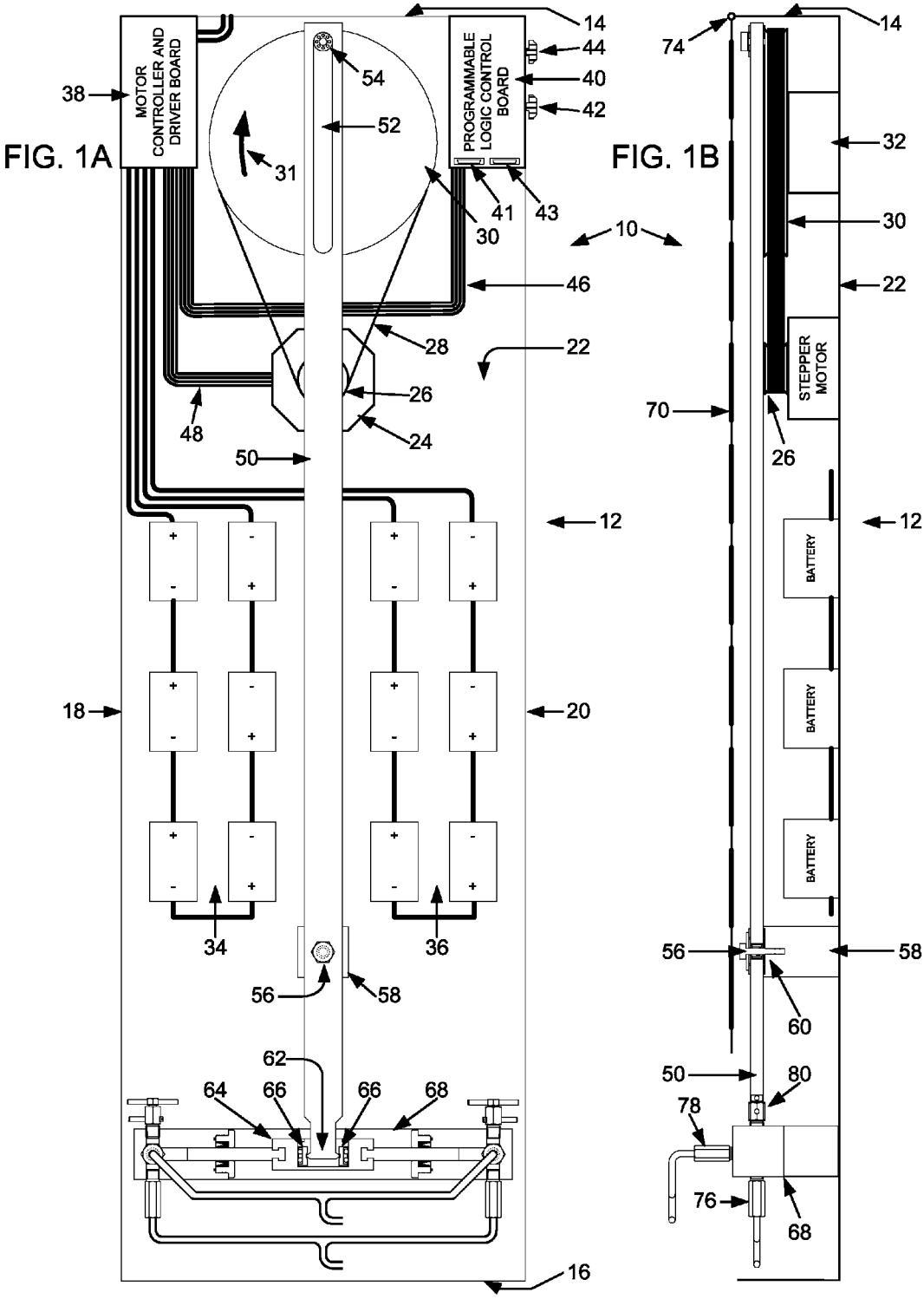
FIG. 1A comprises a front elevation with the solar panel component removed and in partial cross section, and illustrates the preferred embodiment of the present invention positioned at the starting point of a complete cycle.
FIG. 1B comprises a side elevation in partial cross section and illustrates the preferred embodiment of the present invention with the solar panel in place and giving greater detail to the distance of individual components from the back wall of the preferred embodiment.

FIGS. 1-7 illustrate the preferred embodiment of the apparatus of the present invention referenced by the numeral 10. As illustrated initially in FIG. 1A the liquid pressurization device 10 comprises a rectangular housing 12 comprising an upper wall 14, lower wall 16, a left wall 18, a right wall 20, and a back wall 22 forming an enclosure for the apparatus of the current invention. A motion controlled technology motor 24 is threadably attached to back wall 22 and includes a drive pulley 26 threadably attached to the power shaft of said motion controlled technology motor 24. Drive belt 28 transfers rotational force to transfer pulley 30 as indicated by rotational direction arrow 31. Details of the mounting fixture for transfer pulley 30 are shown in FIG. 1B and referenced by the numeral 32, and provides detail of the elevation of transfer pulley 30 in reference to back wall 22 of the rectangular housing 12 and the alignment of drive pulley 26 with transfer pulley 30, which is provided by mounting fixture 32. Further detail of the threadable connection through an intervening bearing of transfer pulley 30 to mounting fixture 32 can be had in FIG. 3A as designated by the numerals 90 and 92 which will be discussed further. Returning to FIG. 1A. Two banks of six rechargeable/replaceable batteries designated by numerals 34 and 36 provide power and power storage for motion controlled technology motor 24, motor controller and driver board 38, and programmable logic control board 40 for power and control objectives to motion controlled technology motor 24. Firmware routines stored in the programmable logic control board 40 are selected using input elements 42 and 44. Combinations of numerical values as selected with input elements 42 and 44 select said firmware routines to achieve a balance of energy conservation and work performed. Programmable logic control board 40 further comprises input/output connection 41 for firmware revisions and upgrades, and input/output connection 43 for alternate input/output devices such as timers, remote control devices, and data collection devices that may be required for certain applications or operating circumstances. Signals and instructions to achieve said balance of energy conservation and work performed are transmitted from programmable logic control board 40 to motor controller and driver board 38 via wiring harness 46, and from motor controller and driver board 38 to motion controlled technology motor 24 via wiring harness 48. The preferred embodiment 10 further comprises a generally elongated rectangular bar 50, comprising an upper slotted portion 52 for connection to transfer pulley 30 utilizing a threadably attached bearing assembly 54. FIG. 3A provides greater detail of threadably attached bearing assembly 54 and positioning on transfer pulley 30. Returning to FIG. 1A, generally elongated rectangular bar 50 further comprises a connection point 56, which is threadably attached to mounting block 58 through an intervening bearing. FIG. 1B shows detail of threadably attached intervening bearing 60. Returning to FIG. 1A, mounting block 58 is permanently attached to back wall 22, providing a fixed alignment point for all other components of the apparatus. The lower end of generally elongated rectangular bar 50 comprises a contact tip 62 which provides contact points for the exertion of force perpendicular to contact tip 62 left and right. Rotation of transfer pulley 30 causes a lever action that pivots at connection point 56 and creates a pendulum motion to contact tip 62. The curvature of this pendulum motion of contact tip 62 is compensated during transmission to plunger retainer assembly 64, utilizing roller assemblies 66 to exert force to the plunger retainer assembly 64 in a manner that is in alignment with the pressure chamber assembly 68. Greater detail of the compensation of the curved path of contact tip 62 to the plunger retainer assembly 64 is shown in FIGS. 3B, 3C, and 3D, which will be discussed further.

FIG. 1B provides a side elevation in partial cross section of the preferred embodiment 10 showing detail of the mounting fixture 32 and the alignment that it provides for transfer pulley 30, in relation to drive pulley 26. This side elevation of the preferred embodiment 10 also provided greater detail of the aforementioned intervening bearing assembly 60 and the threadable connection of generally elongated rectangular bar 50 at connection point 56 to mounting block 58. The solar panel 70 is attached at the front edge of top wall 14, utilizing a pinned hinge assembly 74. Liquid suction check valve 76, discharge check valve 78, and bleed valve 80 and their connection to pressure chamber assembly 68 can also be seen in greater detail in this figure.

Figure 2A:
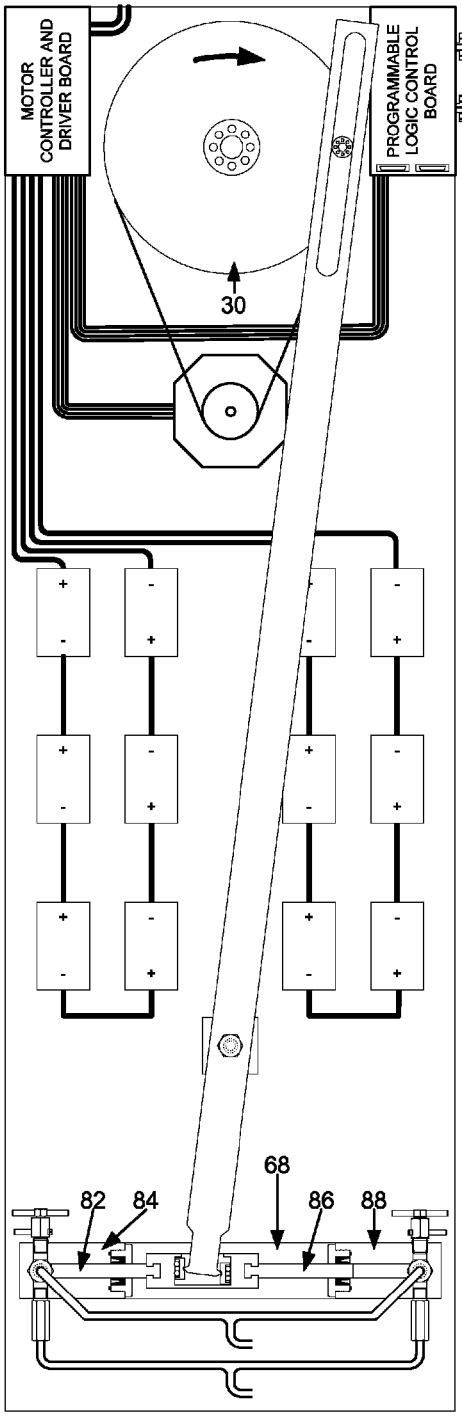
FIG. 2A comprises a front elevation with the solar panel component removed and in partial cross section, with the preferred embodiment of the present invention positioned at the end of the first quarter of a complete cycle.

FIG. 2A provides a front elevation of the preferred embodiment 10 with the solar panel removed and transfer pulley 30 rotated to the end of one fourth of a complete cycle. Correspondingly, left plunger 82 is fully inserted into pressure chamber 84 of pressure chamber assembly 68, and right plunger 86 is in the fully retracted position within right pressure chamber 88 of pressure chamber assembly 68.

Figure 2B:
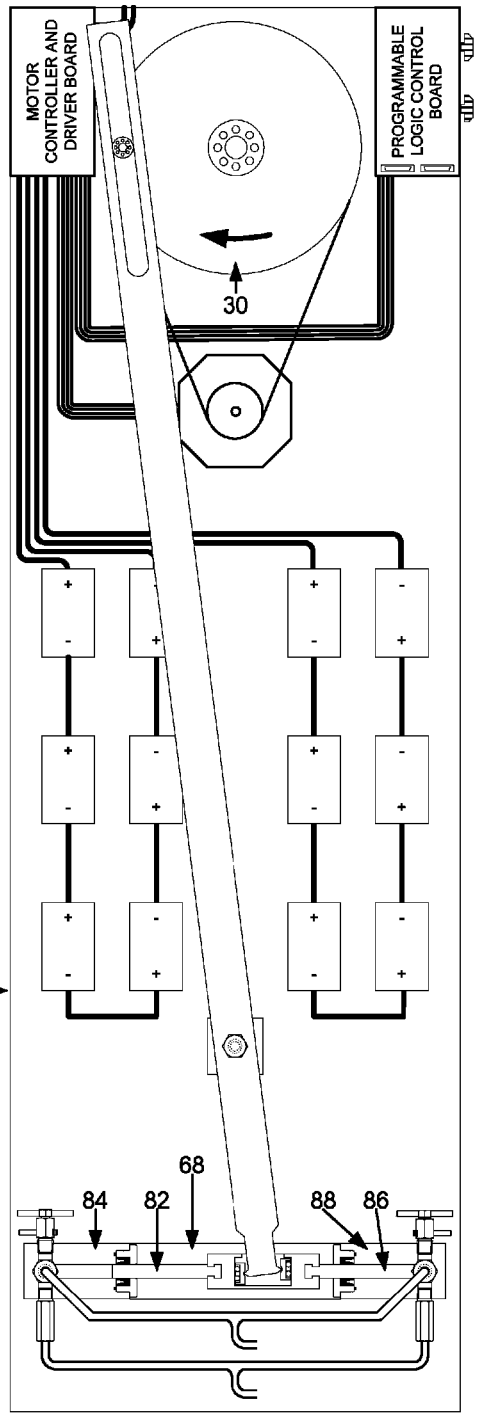
FIG. 2B comprises a front elevation with the solar panel component removed and in partial cross section, with the preferred embodiment of the present invention positioned at the end of the third quarter of a complete cycle.

FIG. 2B provides a front elevation of the preferred embodiment 10 with the solar panel removed and the transfer pulley 30 rotated to the end of three fourths of a complete cycle. Correspondingly, right plunger 86 is fully inserted into right pressure chamber 88 of pressure chamber assembly 68, and left plunger 82 is in the fully retracted position within left pressure chamber 84 of pressure chamber assembly 68.

Figure 3A:
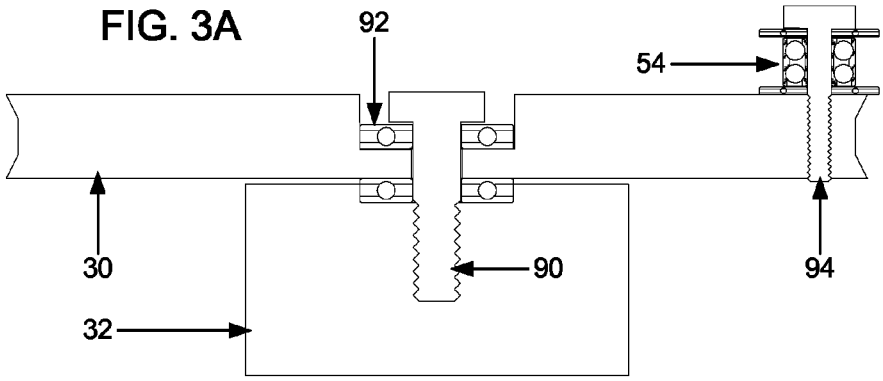
FIG. 3A comprises an enlarged side elevation in cross section, of the transfer pulley component threadably attached to a mounting fixture component with an intervening bearing component, providing greater detail to the connection point for the generally elongated rectangular bar component of the apparatus.

FIG. 3A provides an enlarged side elevation in cross-section of transfer pulley 30 and the threadable attachment 90 to mounting fixture 32 through intervening bearing 92. Threadable attachment 94 of bearing assembly 54 to transfer pulley 30 is also shown in greater detail in this figure.

Figure 3B:
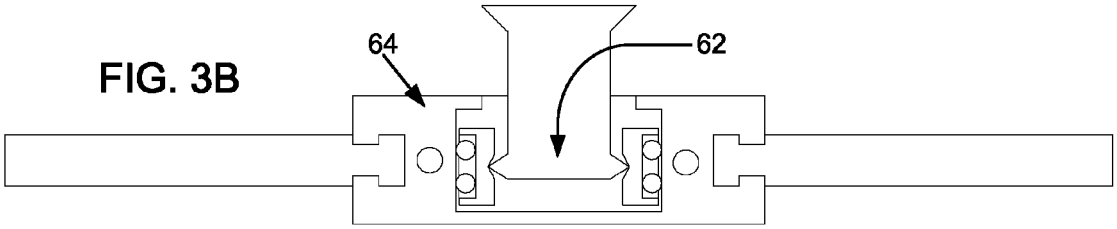
FIG. 3B comprises an enlarged front elevation in cross section, of the plunger retainer assembly and the lower end of the generally elongated rectangular bar component, providing greater detail to the contact points therein and representing the preferred embodiment at the starting point, and half way point, of one complete cycle.

FIG. 3B provides an enlarged front elevation in cross-section of plunger retainer assembly 64 and contact tip 62 and their positions at the beginning of, and the one half point, of one complete cycle.

Figure 3C:
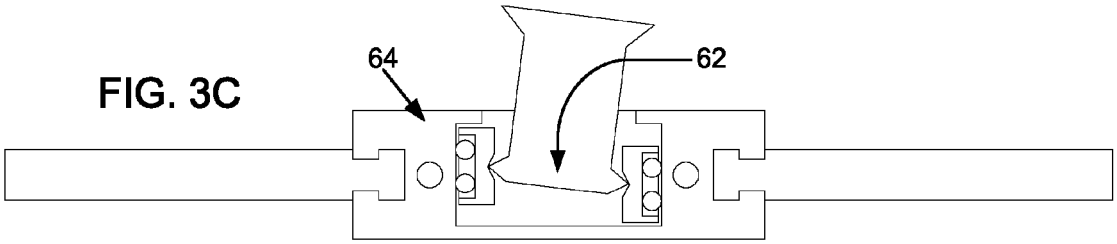
FIG. 3C comprises an enlarged front elevation in cross section, of the plunger retainer assembly and the lower end of the generally elongated rectangular bar component, providing greater detail to the contact points therein, and representing the preferred embodiment at the end of one quarter of a complete cycle.

FIG. 3C provides an enlarged front elevation in cross-section of plunger retainer assembly 64 and contact tip 62 and their positions at the end of one fourth of one complete cycle.

Figure 3D:
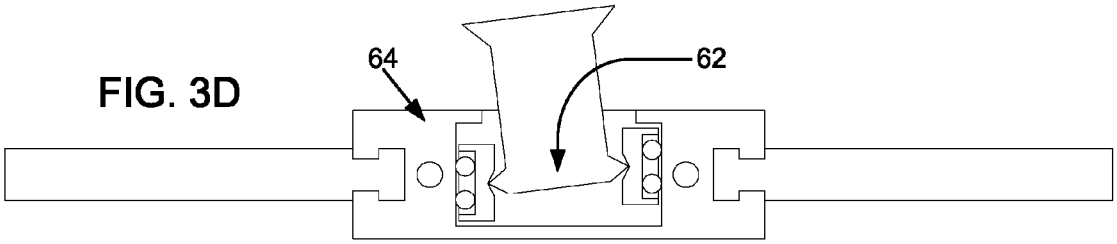
FIG. 3D comprises an enlarged front elevation in cross section, of the plunger retainer assembly and the lower end of the generally elongated rectangular bar component, providing greater detail to the contact points therein, and representing the preferred embodiment at the end of three quarters of a complete cycle.

FIG. 3D provides an enlarged front elevation in cross-section of plunger retainer assembly 64 and contact tip 62 and their positions at the end of three fourth of one complete cycle.

Figure 3E:
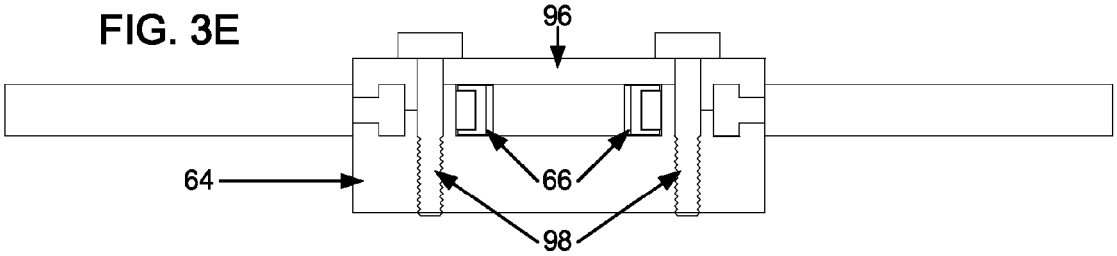
FIG. 3E comprises an enlarged bottom elevation in cross section, of the plunger retainer assembly, providing greater detail to the method for retaining the lower end of the generally elongated rectangular bar component therein.

FIG. 3E provides an enlarged bottom elevation in cross-section of plunger retainer assembly 64, with upper cap portion 96 installed and threadable attachments 98 in place. This figure also provides greater detail to the enclosure of roller assemblies 66.

Figure 4A:
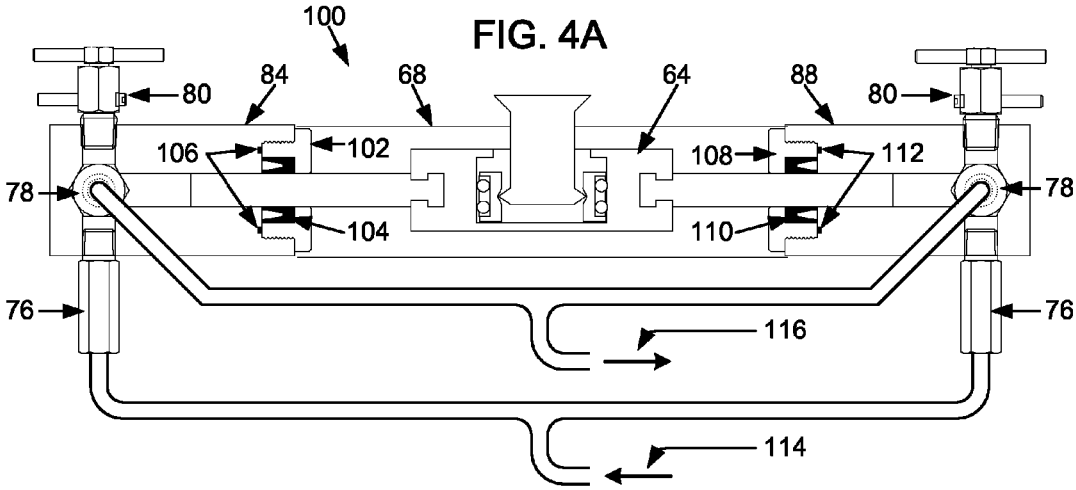
FIG. 4A comprises a front elevation of the liquid pressurization assembly of the apparatus in partial cross-section, to illustrate details of the internal components of the liquid pressurization assembly in conjunction with the inlet and outlet ports and liquid flow paths.

FIG. 4A provides an enlarged front elevation in partial cross section of the plunger retainer assembly 64 installed on pressure chamber assembly 68, further referenced as the liquid end and designated by the numeral 100. Liquid end 100 further comprises threadable left seal retainer 102, retaining left plunger sealing element 104, and utilizing left o-ring 106 to seal threadable left seal retainer 102 within left pressure chamber 84. Liquid end 100 further comprises threadable right seal retainer 108, retaining right plunger sealing element 110, and utilizing right o-ring 112 to seal threadable right seal retainer 108 within right pressure chamber 88. This front elevation of liquid end 100 in partial cross section provides understanding to the principle of constant liquid output of the liquid pressurization apparatus wherein movement of the plunger retainer assembly 64, in either direction left or right, provides liquid pressurization in that direction, and suction of low pressure liquids from the other, and vice-versa. Suction check valves 76, discharge check valves 78, and bleed valves 80, are common to persons skilled in the art and were not provided in cross section at this enlargement. Liquid suction direction arrow 114 and liquid discharge direction arrow 116 are provided for an understanding of the flow path of liquid end 100.

Figure 4B:
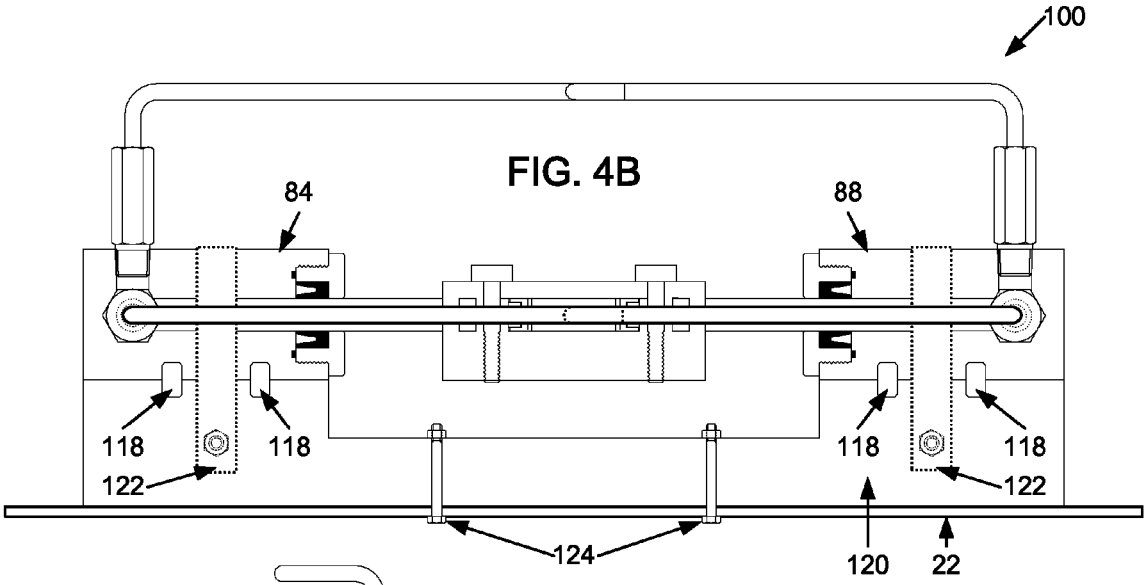
FIG. 4B comprises a bottom elevation of the liquid pressurization assembly of the apparatus in partial cross-section, providing further detail of the internal components of the liquid pressurization assembly that could not be had in FIG. 4A. Details of the dowel pins that position the pressure chambers, the brackets that retain the pressure chambers to the mounting block, and the bolts that secure the mounting block to the front of the back wall of the rectangular housing, can also be had in FIG. 4B FIG. 4C comprises a right elevation of the liquid pressurization assembly of the apparatus in partial cross-section and shows further detail to the dowel pins that position the pressure chambers, and the brackets that retain the pressure chambers to the mounting block.

FIG. 4B provides an enlarged bottom elevation, in partial cross section of liquid end 100, and provides detail to the dowel pin connections 118 that align the plunger bore of left pressure chamber 84 with the plunger bore of right pressure chamber 88 utilizing pressure chamber mounting block 120. The pressure chambers are secured to the pressure chamber mounting block 120 with clamping fixtures 122 which will be discussed further. Liquid end 100 is secured to rectangular housing back wall 22, utilizing stress resistant threadable elements 124.

Figure 4C:
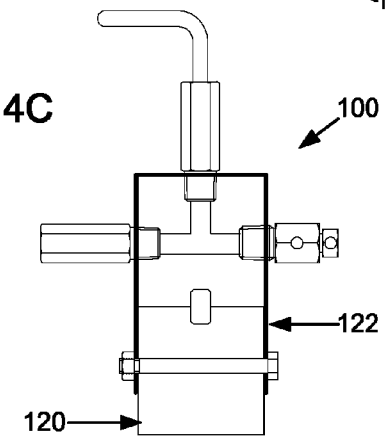
FIG. 4D comprises a right elevation of the clamping fixture that secures the pressure chambers to the mounting block.

FIG. 4C provides an enlarged right elevation of liquid end 100, in partial cross section, showing detail of clamping fixtures 122 and their threadable attachment through pressure chamber mounting block 120.

Figure 4D:
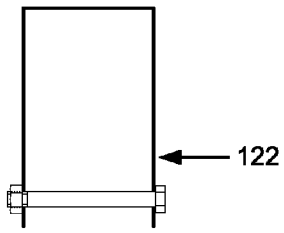

FIG. 4D provides and enlarged right elevation of clamping fixture 122 not installed on the liquid end.

Figure 5:
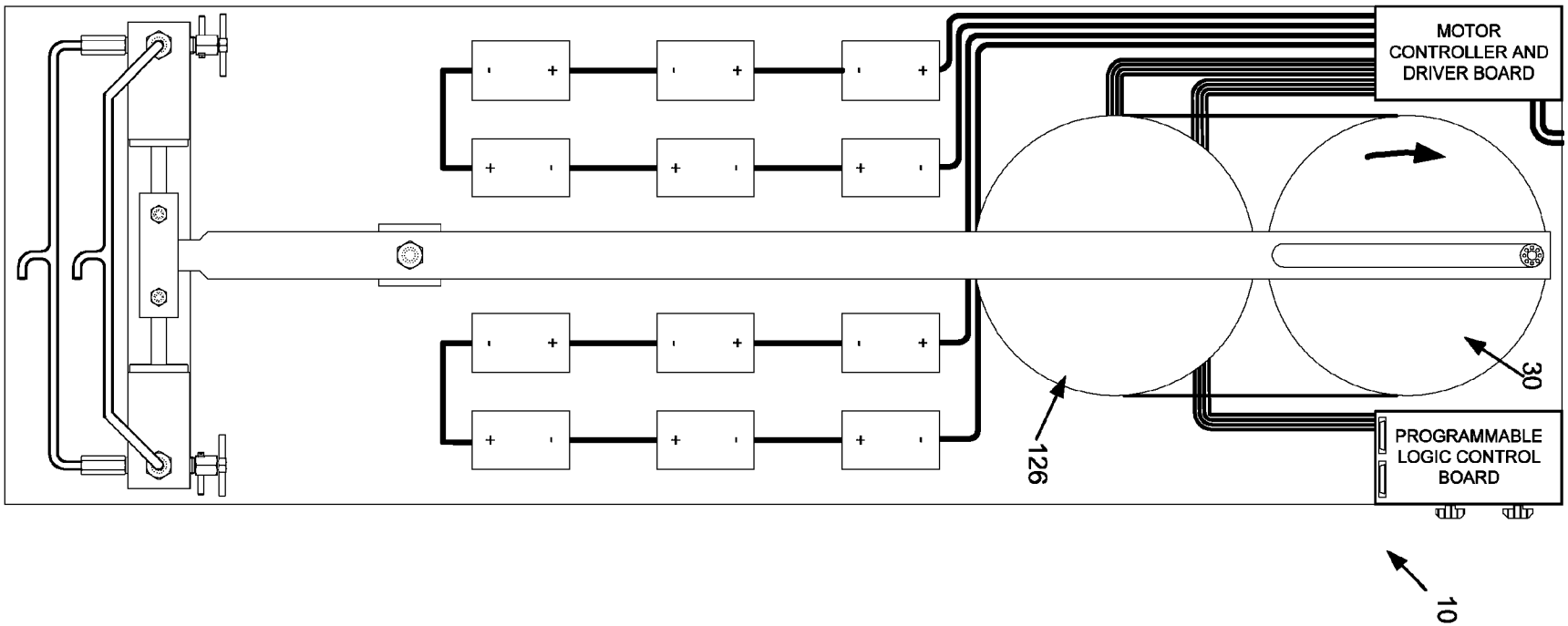
FIG. 5 comprises a front elevation with the solar panel component removed to illustrate the motion controlled technology motor with a maximum sized pulley, equal in diameter to the transfer pulley, installed on said motion controlled technology motor, and offering a one to one ratio for high volume, low pressure liquid pressurization applications.

FIG. 5 provides a front elevation of the preferred embodiment 10, with the solar panel removed, and shows detail of an enlarged drive pulley 126 in place of the drive pulley designated by the numeral 26 in FIGS. 1A and 1B. Returning to FIG. 5, enlarged drive pulley 126 is equal in diameter to transfer pulley 30, providing a one to one power ratio, and the ability to deliver high volumes of liquid into lower pressure vessels or flow lines.

Figure 6:
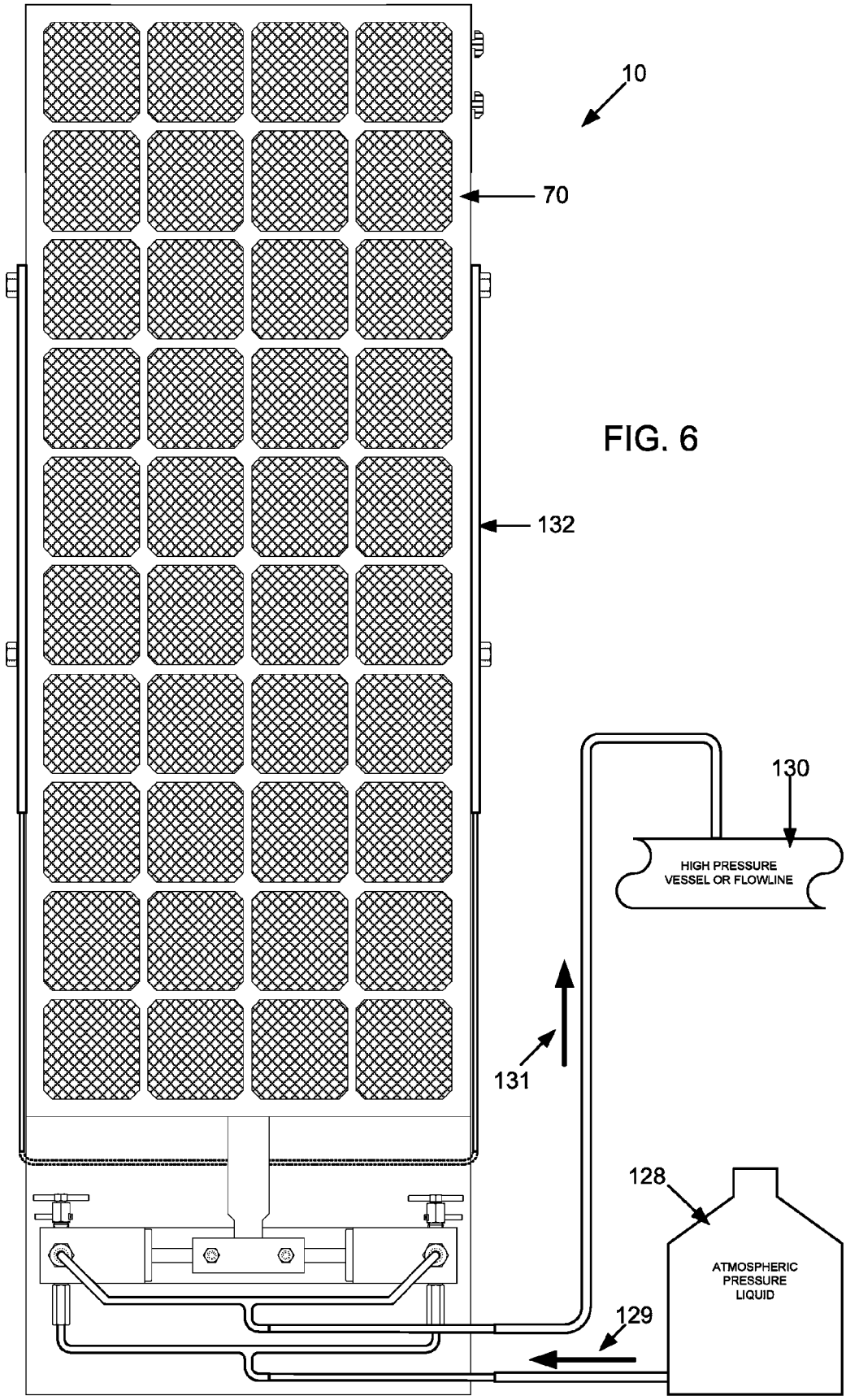
FIG. 6 comprises a front elevation and illustrates the preferred embodiment of the present invention as it would appear in service, including a simplified depiction of the process it is designed to achieve.

FIG. 6 provides a front elevation of the preferred embodiment 10 with solar panel 70 installed and in position for service. An atmospheric pressure liquid container 128 and a section of a higher pressure vessel or flow line 130 were added to the figure to illustrate the work that preferred embodiment 10 performs as further indicated by atmospheric pressure liquid flow direction arrow 129, and pressurized liquid flow direction arrow 131. Support fixture 132 is shown installed onto preferred embodiment 10 in the figure, and will be discussed further.

Figure 7:
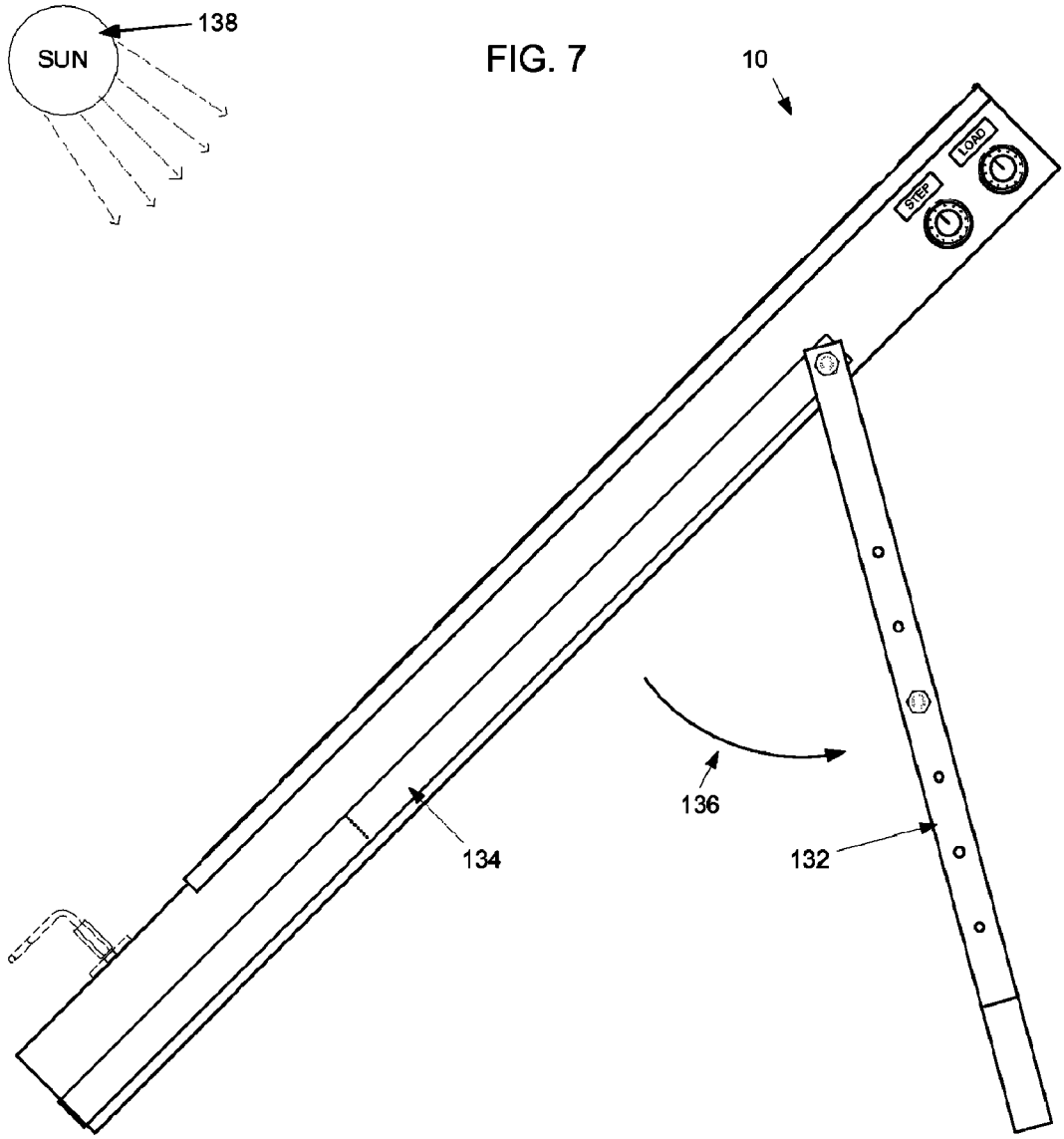
FIG. 7 comprises a side elevation and illustrates the preferred embodiment of the present invention as it would appear in service. The support fixture for the preferred embodiment is designed to allow for placement of the apparatus wherein the solar panel element achieves maximum exposure to sunlight.

FIG. 7 provides a side elevation of the preferred embodiment 10 with support fixtures 132 extended from their stored position 134 to their current position as depicted by arrow 136, providing maximum exposure to the solar energy source 138.

What is claimed is:

1. A liquid pressurization apparatus comprising:

a. A transfer pulley component fitted with a threadably attached bearing that connects to a slot in a generally elongated rectangular bar component wherein rotation of the pulley causes a reciprocating motion to the top of the generally elongated rectangular bar component;

b. A generally elongated rectangular bar component that is threadably attached to a mounting block with an intervening bearing, with the location of the mounting block providing a pivot point one fifth of the distance from the bottom of the generally elongated rectangular bar, and four fifths of the distance from the top of the generally elongated rectangular bar;

c. A generally elongated rectangular bar component with a bottom end having two triangular contact points perpendicular to the generally elongated rectangular bar, and pointing to the left and right;

d. A pressure chamber assembly comprising two pressure chambers pinably attached to a mounting block with sealable ports facing the center of the pressure chamber assembly;

e. A plunger retaining assembly comprising a drive portion fitted with roller assemblies that are positioned to receive force from the two triangular contact points located at the bottom of the generally elongated rectangular bar component;

f. A plunger retaining assembly comprising a socket left and right for mounting of plungers for delivery in to and out of the pressure chambers.

2. The apparatus in claim 1, wherein the rotation of the transfer pulley component provides a five to one leverage to the triangular contact points located at the bottom of the generally elongated rectangular bar at the top vertical point of a rotation of said transfer pulley, and a minimum four to one leverage at the bottom vertical point of a rotation of said transfer pulley.

3. The apparatus in claim 1, wherein the generally elongated rectangular bar mounting block is permanently attached to the back wall of the rectangular housing to serve as a monument for the alignment of all other internal components of the liquid pressurization apparatus.

4. The apparatus in claim 1, wherein the roller assemblies within the drive portion of the plunger retaining assembly convert an otherwise curved path of force to a straight path for the plungers to travel in and out of the pressure chambers in alignment with the bore within said pressure chambers.

5. The apparatus in claim 1, wherein the plunger retaining assembly can be disassembled with the removal of two threadable elements, allowing replacement of the plungers and access to the threadable seal retainers of the pressure chambers for replacement of the seal components.

6. The apparatus in claim 1, wherein a variety of different diameter plungers and matching internal diameter pressure chambers can be utilized to further optimize energy conservation by matching said plunger and pressure chamber size to the required pressure output and desired volume output.

* * * * *